US007471074B2

(12) United States Patent
Srinivasan

(10) Patent No.: US 7,471,074 B2
(45) Date of Patent: Dec. 30, 2008

(54) RE-REFERENCING A REFERENCE VOLTAGE

(75) Inventor: Vishnu S. Srinivasan, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 426 days.

(21) Appl. No.: 10/977,222

(22) Filed: Oct. 29, 2004

(65) Prior Publication Data

US 2006/0091873 A1 May 4, 2006

(51) Int. Cl.
*G05F 3/16* (2006.01)
*G05F 3/20* (2006.01)

(52) U.S. Cl. ..... 323/313; 323/314; 323/315; 323/316

(58) Field of Classification Search ..... 323/313, 323/314, 315, 316
See application file for complete search history.

(56) References Cited

U.S. PATENT DOCUMENTS 4,820,968 A * 4/1989 Wrathall ..... 323/316
5,668,468 A * 9/1997 Cargill ..... 323/316
5,796,278 A * 8/1998 Osborn et al. ..... 327/108
6,114,843 A * 9/2000 Olah ..... 323/280
6,121,824 A * 9/2000 Opris ..... 327/539
6,252,390 B1 * 6/2001 Black et al. ..... 324/127
6,304,108 B1 * 10/2001 Inn ..... 327/72
6,384,586 B1 * 5/2002 Sugawara ..... 323/313
6,388,508 B1 * 5/2002 Kawasumi ..... 327/543
6,407,622 B1 * 6/2002 Opris ..... 327/539
6,507,180 B2 * 1/2003 Eguchi ..... 323/314
6,549,065 B2 * 4/2003 Opris ..... 327/539
6,570,371 B1 * 5/2003 Volk ..... 323/315
6,624,697 B2 * 9/2003 Taylor ..... 330/258
6,937,055 B2 * 8/2005 Roy et al. ..... 326/30
6,989,692 B1 * 1/2006 Wong ..... 327/77
7,049,884 B2 * 5/2006 Korner ..... 329/302
7,075,373 B2 * 7/2006 Briskin et al. ..... 330/298
7,301,366 B1 * 11/2007 Devnath et al. ..... 326/30
2008/0012606 A1 * 1/2008 Fujita ..... 327/103

* cited by examiner

*Primary Examiner*—Bao Q Vu
(74) *Attorney, Agent, or Firm*—Trop, Pruner & Hu, P.C.

(57) ABSTRACT

An apparatus includes a first voltage reference circuit, a second voltage reference circuit and a third circuit that is coupled to the second voltage reference circuit. The first voltage reference circuit provides a first reference voltage between a terminal of the first voltage reference circuit and a first power line. The second voltage reference circuit provides a second reference voltage between a terminal of the second voltage reference circuit and a second power line that is separate from the first power line. The third circuit is coupled to the second voltage reference circuit to establish a magnitude of the second reference voltage in response to a potential difference between the terminal of the first voltage reference circuit and the second power line.

44 Claims, 8 Drawing Sheets

RE-REFERENCING A REFERENCE VOLTAGE

BACKGROUND

The invention generally relates to generating a bias voltage.

Referring to FIG. 1, a differential amplifier 10 typically includes differential transistors 12 that receive and amplify a differential input signal (that appears across input terminals 16 and 18 of the amplifier 10) to produce a differential output signal across output terminals 26 and 28. The differential amplifier 10 may also include other transistors, such as a current mirror transistor 11 and cascode transistors 14.

The differential amplifier 10 may be a low noise, radio frequency (RF) amplifier, which means the transistors of the amplifier 10 should be designed to be relatively fast and contribute a relatively small level of noise to the differential output signal. A potential challenge in using such a transistor is that the transistor typically can sustain only a relatively small (1.2 volts, for example) voltage across any two of its terminals while the supply voltage may be much higher (3.3 volts, for example).

Bias circuitry 20 provides bias voltages to set the various operating points of the transistors of the amplifier 10. For example, as depicted in FIG. 1, the differential transistors 12 may be biased by a reference voltage (called "$V_{BD}$") that is coupled to the gate terminals of the transistors 12, and the cascode transistors 14 may be biased by a reference voltage (called "$V_{BC}$") that is coupled to the gate terminals of the transistors 14.

As depicted in FIG. 1, both the $V_{BD}$ and $V_{BC}$ reference voltages may be generated by ground-referenced voltage reference circuits, such as the depicted circuits 24 and 22, respectively. "Ground-referenced" means that each of the reference circuits 22 and 24 maintains its output reference voltage with respect to ground.

Because the voltage reference circuits 22 and 24 are referenced to ground, the $V_{BC}$ and $V_{BD}$ reference voltages do not vary with a supply voltage (called "$V_{DD}$") that is coupled to the differential amplifier 10. This presents challenges because the operating points of the amplifier's transistors also depend on the voltage differences between the $V_{DD}$ supply voltage and the $V_{BD}$ and $V_{BC}$ reference voltages.

More specifically, the $V_{DD}$ supply voltage typically is directly supplied by or is a function of the external supply voltage that is furnished to an integrated circuit package that contains the differential amplifier 12; and as a result, the $V_{DD}$ supply voltage is expected to be not at a specific voltage level, but rather the expected voltage level of the $V_{DD}$ supply voltage is defined by a range, such as 2.7 to 3.3 volts. The actual voltage level of the $V_{DD}$ supply voltage depends on the external supply voltage. Although the expected value of the $V_{DD}$ supply voltage is defined by a range of voltages, the $V_{BC}$ and $V_{BD}$ reference voltages are designed to be specific voltages with respect to ground, which do not vary with the actual $V_{DD}$ supply voltage. Therefore, non-optimum operating points may be established in the differential amplifier 10, depending on the actual $V_{DD}$ supply voltage.

One way to ensure that the reference voltages vary with the $V_{DD}$ supply voltage is to use voltage reference circuits that are referenced to the $V_{DD}$ supply voltage instead of being referenced to ground. However, for a low noise amplifier design, this solution may be undesirable because the $V_{DD}$ supply voltage may be relatively noisy and thus, may introduce an undesirable level of noise into the differential amplifier 10. This may also be a problem because the input circuit (to the amplifier 10) may be ground-referenced.

Thus, there is a continuing need for a better technique and/or system to bias circuitry, such as a differential amplifier. There is also a continuing need for a bias circuit that furnishes the appropriate bias voltages as the supply voltage scales down.

SUMMARY

In an embodiment of the invention, an apparatus includes a first voltage reference circuit, a second voltage reference circuit and a third circuit that is coupled to the second voltage reference circuit. The first voltage reference circuit provides a first reference voltage between a terminal of the first voltage reference circuit and a first power line. The second voltage reference circuit provides a second reference voltage that is referenced between a terminal of the second voltage reference circuit and a second power line that is separate from the first power line. The third circuit is coupled to the second voltage reference circuit to establish a magnitude of the second reference voltage in response to a potential difference between the terminal of the first voltage reference circuit and the second power line.

In another embodiment of the invention, an apparatus includes a first voltage reference circuit, a second voltage reference circuit and a third circuit that is coupled to the second voltage reference circuit. The first voltage reference circuit provides a first reference voltage between a terminal of the first voltage reference circuit and a supply voltage line. The second voltage reference circuit provides a second reference voltage that is referenced between a terminal of the second voltage reference circuit and a ground that is separate from the supply voltage line. The third circuit is coupled to the second voltage reference circuit to establish a magnitude of the second reference voltage in response to a potential difference between the terminal of the first voltage reference circuit and ground.

In another embodiment of the invention, a technique includes receiving a first reference voltage that exists between a first terminal and a first power line. The technique includes providing a second reference voltage that is referenced between a second terminal and a second power line that is separate from the first power line. The technique also includes regulating a magnitude of the second reference voltage in response to a potential difference between the terminal of the first terminal and the second power line.

In another embodiment of the invention, a system includes a wireless interface, a first voltage reference circuit, a second voltage reference circuit and a third circuit. The wireless interface includes an amplifier to receive the second reference voltage to bias the amplifier. The first voltage reference circuit provides a first reference voltage between a terminal of the first voltage reference circuit and a supply voltage line. The second voltage reference circuit provides a second reference voltage between a terminal of the second voltage reference circuit and ground. The circuit is coupled to the second voltage reference circuit to establish a magnitude of the second reference voltage in response to a potential difference between the terminal of the first voltage reference circuit and ground.

In another embodiment of the invention, a technique includes providing a ground-based reference voltage circuit to provide a reference voltage to bias another circuit. The technique includes controlling the reference voltage circuit to track changes in a supply voltage.

In yet another embodiment of the invention, a technique includes generating a reference voltage that is referenced to a first power line. The technique also includes re-referencing the reference voltage to a second power line that is separate from the first power line.

Advantages and other features of the invention will become apparent from the following description, drawing and claims.

DETAILED DESCRIPTION

Figure 1:
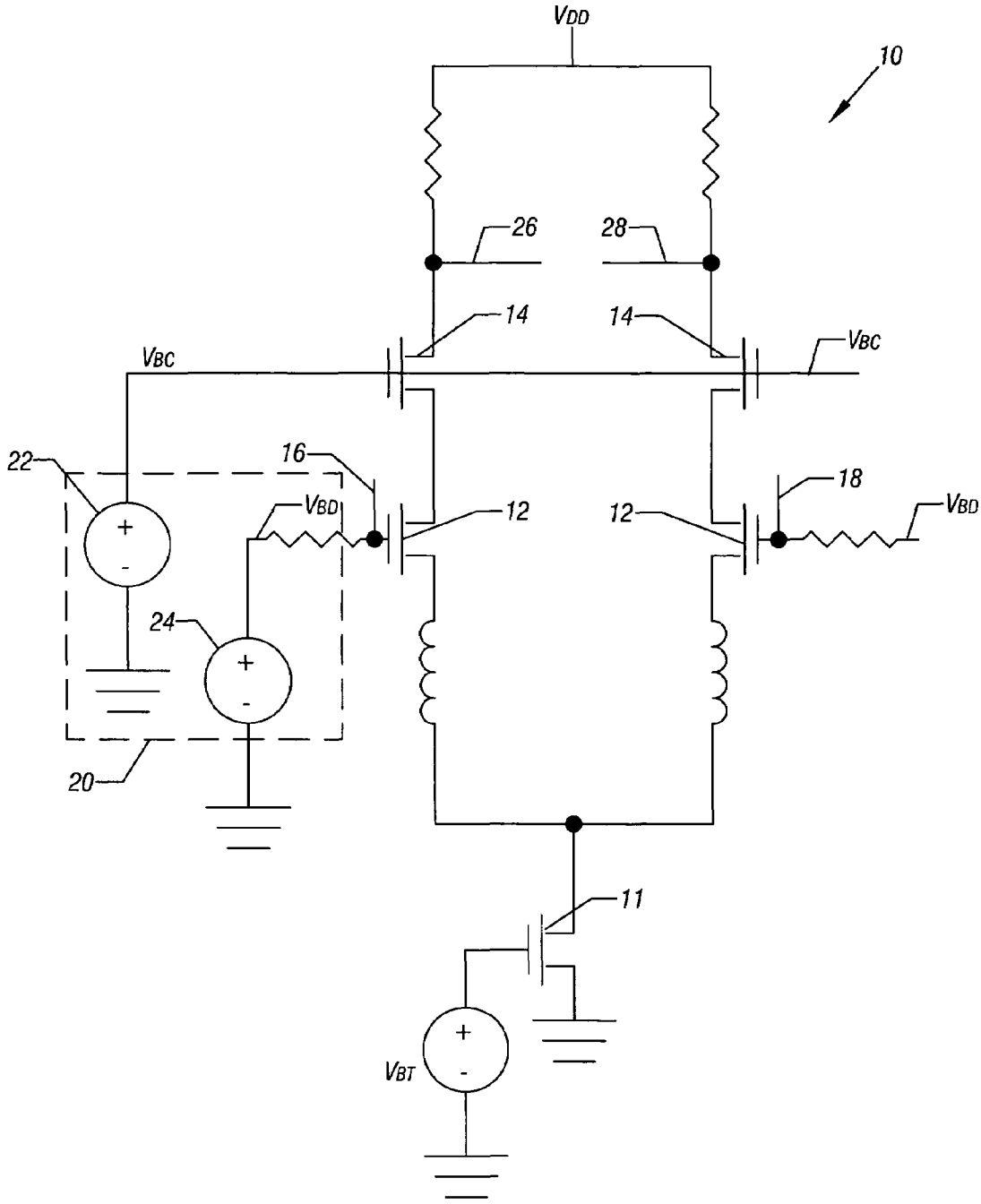
FIG. 1 (PRIOR ART)
FIG. 1 is a schematic diagram of a differential amplifier of the prior art.
Figure 2:
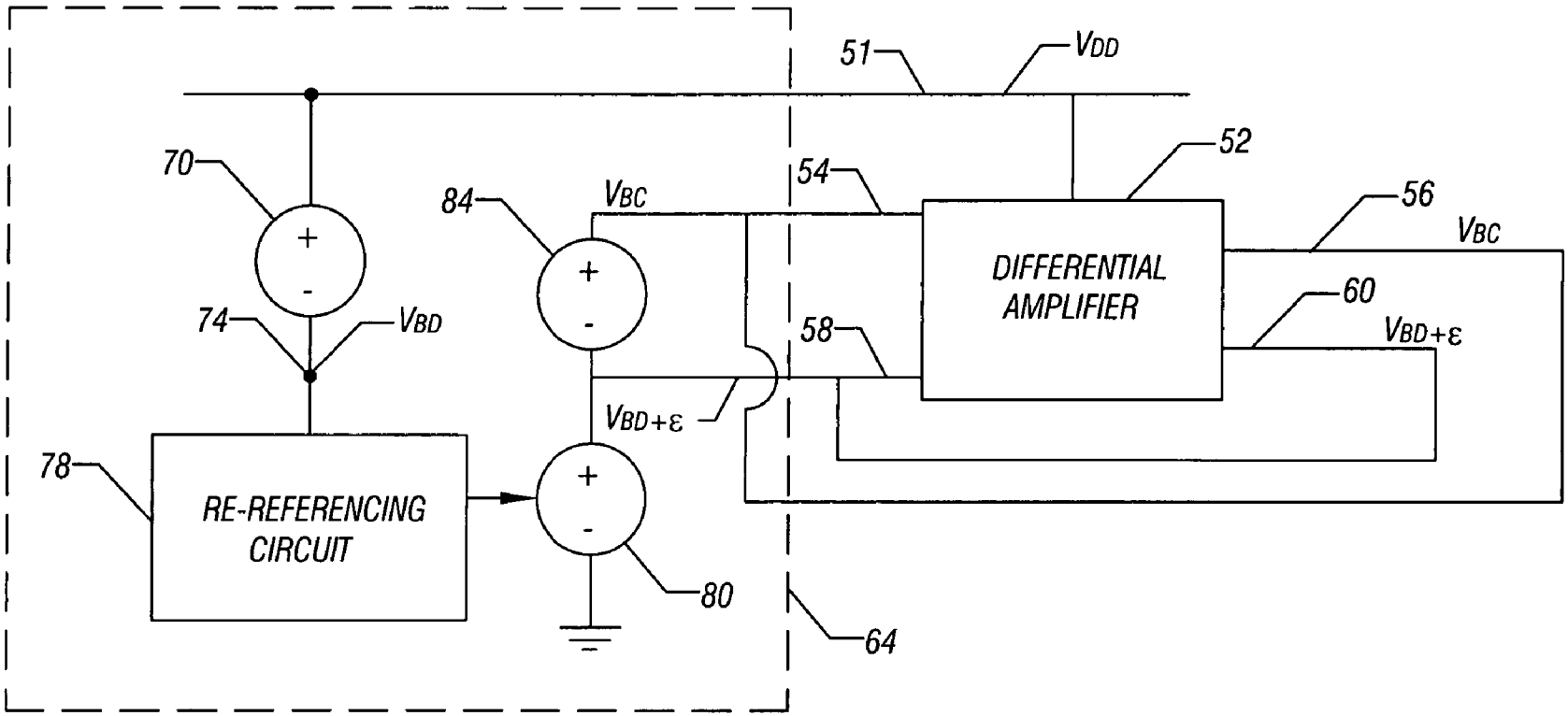
FIG. 2 is a schematic diagram depicting a system to bias a differential amplifier according to an embodiment of the invention.

Referring to FIG. 2, in accordance with an embodiment of the invention, a system 64 to bias a differential amplifier 52 includes at least one ground-referenced voltage reference circuit to provide a reference voltage to the amplifier 52. For example, in some embodiments of the invention, a ground-referenced voltage reference circuit 80 provides a bias voltage (called "$V_{BD+\epsilon}$") that is coupled to gate terminals 58 and 60 of differential transistors of the differential amplifier 52. In some embodiments of the invention, gate terminals of cascode transistors of the amplifier 52 may be coupled to a reference voltage (called "$V_{BD}$") that is generated by a voltage reference circuit 84, a circuit that is serially coupled to the positive terminal of the voltage reference circuit 80.

Because the voltage reference circuit 80 is referenced to ground, neither voltage reference circuit 80 nor voltage reference circuit 84 communicates noise from a supply voltage (called "$V_{DD}$" and appearing on a $V_{DD}$ supply voltage line 51) to the differential amplifier 52. Therefore, the differential amplifier 52 may be used in relatively low noise applications. Furthermore, this low noise design is beneficial to reducing noise that may also be coupled through the supply line 51 (indirectly) to an input circuit (a filter, for example) and thus, to the differential amplifier 52 as well.

The system 64 may be part of a larger integrated circuit package that includes (not shown) circuitry to generate the $V_{DD}$ Supply voltage (either directly or indirectly) in response to an external supply voltage that is received over external pins of the package, and thus, the external level of the $V_{DD}$ supply voltage may be defined by a voltage range. For example, in some embodiments of the invention, the $V_{DD}$ supply voltage may have an expected level between approximately 2.7 to 3.3 volts. Due to this range, bias voltages in the differential amplifier 52 may vary significantly with respect to the $V_{DD}$ supply voltage over this range, if not for the actions of a re-referencing circuit 78 of the system 64.

In some embodiments of the invention, the re-referencing circuit 78 controls the voltage reference circuit 80 to cause the $V_{BD+\epsilon}$ voltage to vary with the $V_{DD}$ supply voltage. Therefore, for example, the operating points of the differential amplifier 52 may be designed based on an assumed $V_{BD+\epsilon}$ voltage. Regardless of the specific level of the $V_{DD}$ supply voltage over its potential range, the voltage reference circuit 80 maintains the assumed bias voltage and thus, maintains the desired operating points of the differential amplifier 52.

For purposes of tracking the $V_{DD}$ supply voltage, in some embodiments of the invention, a voltage reference circuit 70 provides a voltage (herein called "$V_{BD}$") that is referenced to the $V_{DD}$ supply voltage. In some embodiments of the invention, one of the goals of the system 64 is to ensure that the $V_{BD+\epsilon}$ bias voltage corresponds (is near or equal to, for example) to the $V_{BD}$ voltage. In some embodiments of the invention, the re-referencing circuit 78 is coupled to an output node 74 of the voltage reference circuit 70, and the output node 74 furnishes the $V_{BD}$ voltage. The voltage reference circuit 70 essentially serves to maintain a voltage between the node 74 and the $V_{DD}$ supply voltage, which is generally constant relative to the $V_{DD}$ supply voltage (although the voltage supplied by the voltage reference circuit 70 may change with operation conditions (like temperature, for example) and process parameters). Therefore, changes in the $V_{DD}$ supply voltage cause corresponding changes in the $V_{BD}$ voltage that appears at the output node 74.

It may not be desirable for the voltage reference circuit 70 to directly provide a bias voltage for the differential amplifier 52 because the voltage reference circuit 70 may communicate potential noise from the $V_{DD}$ supply voltage. Therefore, in accordance with some embodiments of the invention, the re-referencing circuit 78 controls the voltage reference circuit 80, a ground-based reference, to generate the $V_{BD+\epsilon}$ reference voltage, a low noise reference voltage that varies with the $V_{DD}$ supply voltage.

In some embodiments of the invention, the $V_{BD+\epsilon}$ voltage is a voltage that is ideally equal to the $V_{BD}$ voltage. The symbol "$\epsilon$" represents an "error" from the $V_{BD}$ voltage that appears on the output node 74 of the voltage reference circuit 70. It is noted that in some embodiments of the invention, $\epsilon$ may be relatively small and may be approximately zero, in some embodiments of the invention. However, in other embodiments of the invention, $\epsilon$ may be approximately equal to a fixed voltage between the $V_{BD}$ and $V_{BD+\epsilon}$ voltages. Thus, many variations are possible in the different embodiments of the invention.

Therefore, due to the above-described biasing scheme, gate terminals 58 and 60 of the differential transistors of the differential amplifier 52 receive a bias voltage that is ground-referenced and varies accordingly with the $V_{DD}$ supply voltage. As also depicted in FIG. 2, in some embodiments of the invention, the voltage reference circuit 84 is serially coupled to the voltage reference circuit 80 so that the voltage reference circuit 84 produces the $V_{BD}$ bias voltage (called "$V_{BC}$") that is communicated to the gate terminals 54 and 56 of the cascode transistors of the differential amplifier 52. Thus, in some embodiments of the invention, the $V_{BC}$ voltage may be a fixed voltage above the $V_{BD+\epsilon}$ voltage. Because the voltage reference circuit 80 is ground-referenced and varies with the $V_{DD}$ supply voltage, the voltage reference circuit 84, through its connection to the voltage reference circuit 80, is also ground-referenced and varies with the $V_{DD}$ supply voltage.

Figure 3:
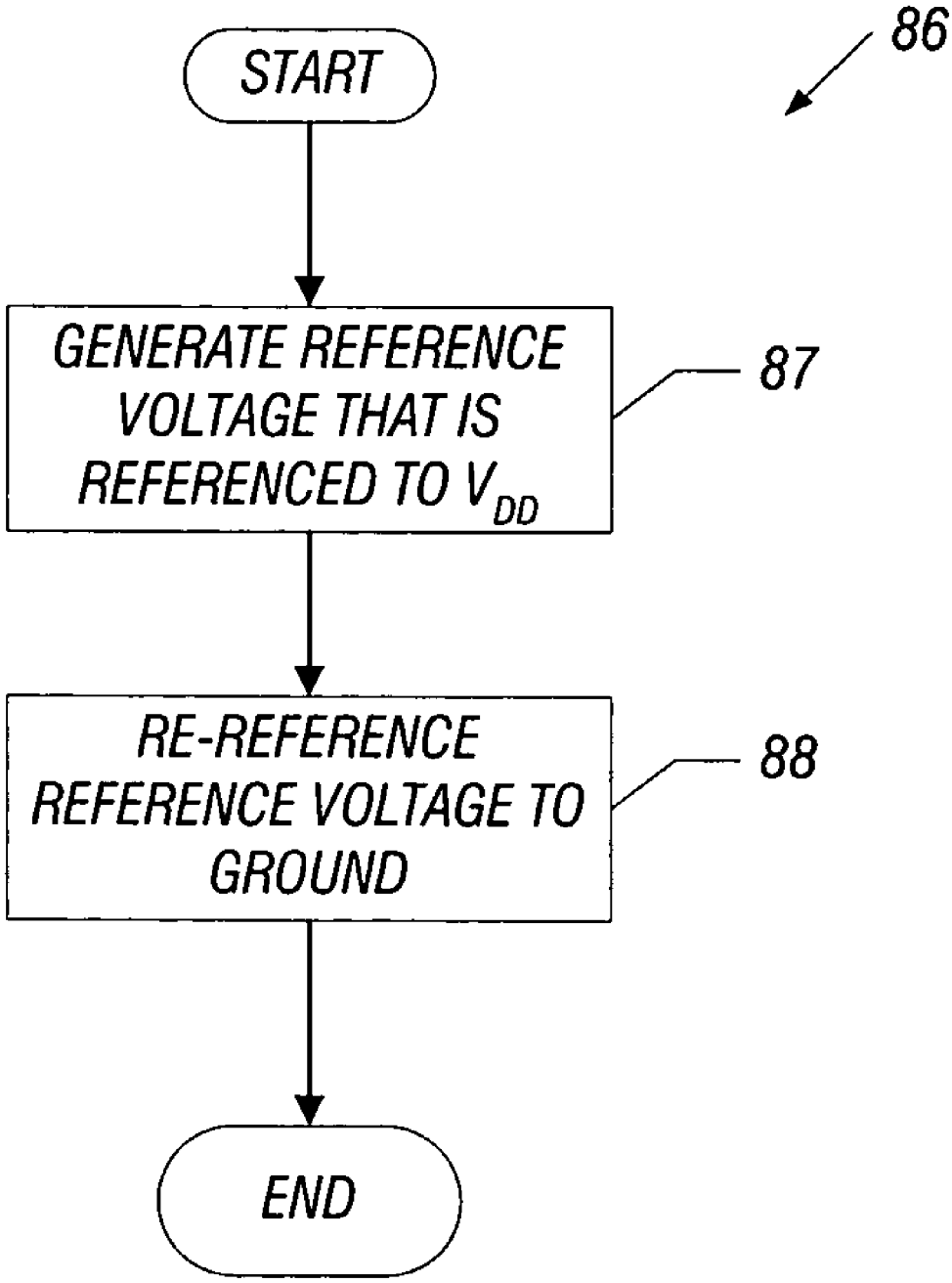
FIG. 3 is a flow diagram depicting a technique to bias a circuit according to an embodiment of the invention.

Therefore, in some embodiments of the invention, a technique 86 that is depicted in FIG. 3 may be used to bias a circuit, such as a circuit (a differential amplifier, for example) of an integrated circuit. Referring to FIG. 3, pursuant to the technique 86, a reference voltage is generated (block 87) that is referenced to the $V_{DD}$ supply voltage. Next, in accordance with the technique 86, the reference voltage is re-referenced to ground, as depicted in block 88.

It is noted that the differential amplifier 52 of FIG. 2 is an example of many possible circuits that may use the re-referencing technique that is disclosed herein. Thus, other circuitry may be biased by a similar arrangement in accordance with other embodiments of the invention. Furthermore, FIG. 2 depicts the system 64 as re-referencing a supply-referenced voltage into a ground-referenced reference voltage, it is understood that the re-referencing may be done in the opposite direction. In other words, in some embodiments of the invention, a ground-referenced, reference voltage may be re-referenced to a supply-referenced, reference voltage. Furthermore, in some embodiments of the invention, the re-referencing that is disclosed herein may apply to power lines other than the $V_{DD}$ supply line and ground. For example, in some embodiments of the invention, re-referencing may occur between a positive supply voltage line and a negative supply voltage line (instead of ground). Thus, many variations are possible and are within the scope of the appended claims.

Figure 4:
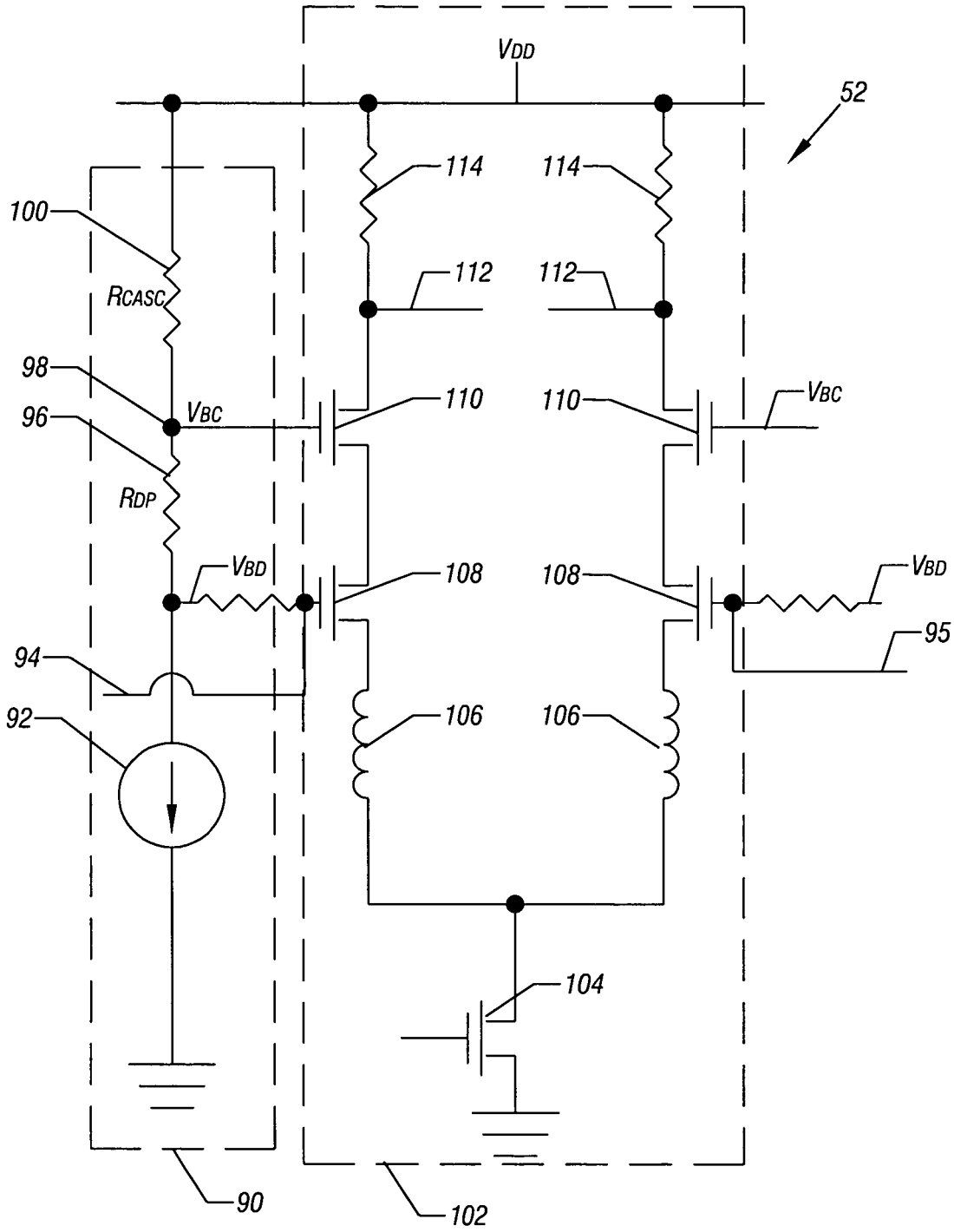
FIG. 4 is a schematic diagram of the differential amplifier of FIG. 2 according to an embodiment of the invention.

In the embodiments of the invention in which the circuitry that is biased is the differential amplifier 52 (FIG. 2), the differential amplifier 52 may have a general form that is depicted in FIG. 4. More specifically, referring to FIG. 4, in some embodiments of the invention, the differential amplifier 52 includes a differential amplifier stage 102 that is coupled to a bias stage 90 that is generally depicted in FIG. 4. It is noted that as depicted in FIG. 4, the bias stage 90 is supply-referenced and may communicate noise from the $V_{DD}$ supply voltage to the differential amplifier 52 or to an input circuit that is coupled to the differential amplifier 52. However, the bias stage 90 may be re-referenced to ground (but vary with the $V_{DD}$ supply voltage) using additional circuitry that is further described below in connection with FIGS. 5-7. The bias stage 90 receives the $V_{BD}$ voltage and generates the $V_{BC}$ voltage in response thereto. Thus, the resistor network 90 forms the voltage reference circuit 84 (FIG. 2), in some embodiments of the invention.

As depicted in FIG. 4, the differential amplifier stage 102 includes differential 108 and cascode 110 transistors. In some embodiments of the invention, these transistors may be metal-oxide-semiconductor field-effect-transistors (MOSFETs). However, these specific transistors are provided as examples only, as other processes and transistors may be used in other embodiments of the invention.

The differential amplifier stage 102 may include, for example, an n-channel MOSFET 104 that provides a current to bias the differential amplifier stage 102. More specifically, in some embodiments of the invention, the source terminal of the MOSFET 104 may be coupled to ground, and the drain terminal of the MOSFET 104 may sink a current that flows through both the left and right sides of the amplifier stage 102. In some embodiments of the invention, the MOSFET 104 may be part of a current mirror (the rest of which is not depicted in FIG. 4). In some embodiments of the invention, the MOSFET 104 may be omitted.

Each side of the differential amplifier stage 102 may have the following structure. The structure includes an inductor 106 that has one terminal that is coupled to the drain terminal of the MOSFET 104 and another terminal that is coupled to the source terminal of the differential transistor 108. In some embodiments of the invention, the differential transistor 108 may be an n-channel MOSFET 108. The gate terminal of the MOSFET 108, in turn, receives the $V_{BD}$ reference voltage and also receives an input signal and is also coupled to one signal input terminal of the differential amplifier stage 102.

In some embodiments of the invention, the cascode transistor 110 is an n-channel MOSFET. In these embodiments of the invention, the MOSFET 110 has its source terminal coupled to the drain terminal of the MOSFET 108. The gate terminal of the MOSFET 110 receives the cascode bias voltage $V_{BC}$ from the bias stage 90. Furthermore, the drain terminal of the MOSFET 110 is coupled to an output terminal 112 of the differential stage 102. In some embodiments of the invention, a resistor 114 may be coupled between the output terminal 110 and the supply voltage line. It is noted that in some embodiments of the invention, the resistor 114 may be formed by one or more MOSFETs.

In some embodiments of the invention, the bias stage 90 may include a current source 92 that is coupled between the gate terminal of the MOSFET 108 and ground. The bias stage 90 also includes a resistor 96 that may be coupled between the gate terminals of the MOSFETs 108 and 110. The resistance of the resistor 96 is called "$R_{DP}$" herein. Furthermore, in some embodiments of the invention, the resistor network 90 includes a resistor 100 that is coupled between the gate terminal of the MOSFET 110 and the supply voltage line 51. The resistance of the resistor 110 is called "$R_{CASC}$" herein.

Thus, the current source 92 produces a current through the resistors 96 and 100 to generate the $V_{BC}$ and $V_{BD}$ voltages. In some embodiments of the invention, the current source 92 may be formed from an n-channel MOSFET that is identical to the MOSFET 104, except that the MOSFETs may have different aspect ratios with respect to each other. These MOSFETs may be connected together in a current mirror arrangement in which due to the different aspect ratios, the currents flowing through the MOSFETs may be scaled relative to each other.

It is noted that FIG. 4 is a general depiction of the differential amplifier 52 and bias stage 90, in that additional circuitry may be present in some embodiments of the invention. For example, in some embodiments of the invention, additional circuitry may be coupled to the above-described MOSFET of the current source 92 and the MOSFET 104 for purposes of preserving performance of the differential amplifier 52 in light of temperature variations and process corners.

As described further below, the bias stage 90 may be incorporated into master and slave circuits for purposes of re-referencing bias voltages to the $V_{DD}$ supply voltage.

Referring back to FIG. 2, the bias circuit 64 may take on various forms, depending on the particular embodiment of the invention. For example, in some embodiments of the invention, the re-referencing circuit 78 and the supply-reference voltage reference circuit 70 may take on the form of a master circuit that controls one or more voltage reference circuits 80 (FIG. 2) that may be distributed throughout a particular integrated circuit. Thus, the master circuit controls the generation of the bias voltages by the slave circuits, and the slave circuits each integrate the bias voltage into the particular circuit being biased.

Figure 5:
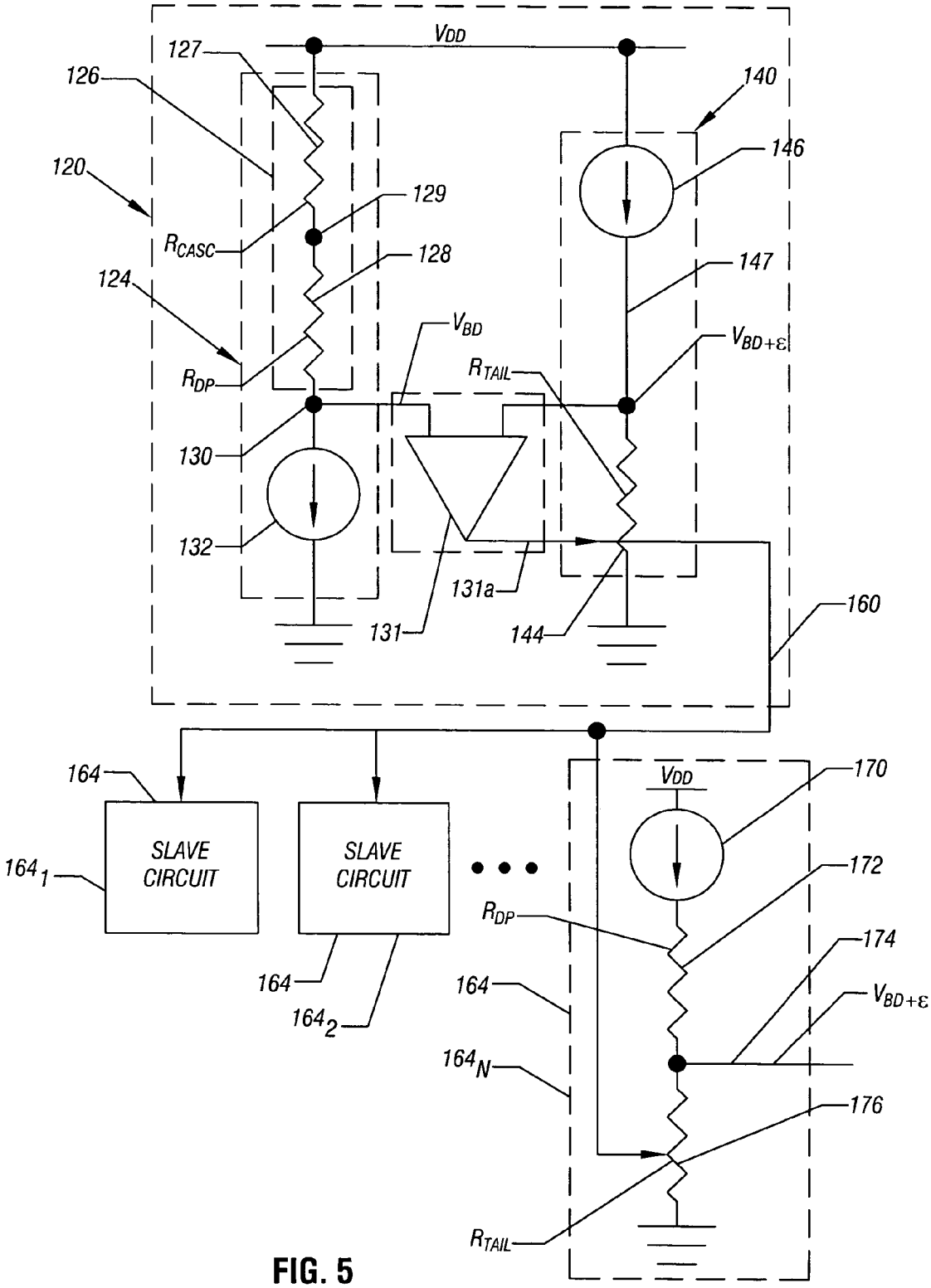
FIGS. 5, 6 and 7 is a schematic diagram of bias circuits according to different embodiments of the invention.

As a more specific example, FIG. 5 depicts a master circuit 120 and slave circuits 164 (slave circuit $\mathbf{164}_1$, $\mathbf{164}_2$ . . . $\mathbf{164}_N$, depicted as an example), each of which establishes a bias voltage in response to the control from the master circuit 124. Each slave circuit 164 may be, in some embodiments of the invention, a ground referenced circuit that generates a bias voltage that varies with changes in the $V_{DD}$ supply voltage.

More specifically, in some embodiments of the invention, the master circuit 120 includes a supply-referenced, reference voltage circuit 124 that has the general form of the bias stage 90 of FIG. 4. In this manner, the reference voltage circuit 124 includes a current source 132 and an equivalent resistor 126 that is formed from a resistor 127 and a resistor 128 that are coupled together in series. More specifically, the resistor 126 is coupled between the supply voltage line and a node 130 that provides the $V_{BD}$ voltage. The current source 132 is coupled between the node 130 and ground to generate a current through the resistor 126 to form a positive voltage $V_{BD}$ at the node 130. Thus, the combination of the resistor 126 and the current source 132 forms the supply-referenced voltage reference circuit 124, a circuit that provides the $V_{BD}$ reference voltage. The resistor 127 has the RCASC resistance (see FIG. 4) of the bias stage 90, and the resistor 128 has the $R_{DP}$ resistance (see FIG. 4) of the bias network 90.

For purposes of converting the supply-referenced $V_{BD}$ reference voltage into the ground-referenced $V_{BD+\epsilon}$ voltage, the master circuit 120 includes a high gain amplifier 131 (a comparator, for example). One input terminal of the amplifier 131 is coupled to the node 130 to receive the $V_{BD}$ voltage. Another input terminal of the amplifier 131 is coupled to a node 147 to receive the $V_{BD+\epsilon}$ voltage. Due to this arrangement, the amplifier 131 amplifies the difference ($\epsilon$) between the $V_{BD+\epsilon}$ and $V_{BD}$ voltages to produce a control signal on an output terminal 131*a* of the amplifier 131. As depicted in FIG. 5, in some embodiments of the invention, the signal that is present on the output terminal 131*a* controls the resistance ($R_{TAIL}$) of a resistor 144. Thus, the resistor 144 may be, for example, a resistor ladder or resistor network that is controlled by the signal on the output terminal 130*a* for purposes of establishing the $R_{TAIL}$ resistance.

The resistor 144 is part of a ground-referenced voltage circuit 140 of the master circuit 120. The voltage reference circuit 140 includes, in addition to the resistor 144, a current source 146 that is coupled between the $V_{DD}$ supply line and the node 147. The resistor 144, in turn, is coupled between the node 147 and ground. The current source 146 generates a current that flows from the $V_{DD}$ supply line to ground through the resistor 144 to produce the $V_{BD+\epsilon}$ voltage. Therefore, due to the feedback arrangement depicted in FIG. 5, the amplifier 131 adjusts the resistance of the resistor 144 to cause the $V_{BD+\epsilon}$ voltage to be close to the $V_{BD}$ voltage (in some embodiments of the invention), accommodating the actual level or magnitude of the variation in the $V_{DD}$ supply voltage.

Thus, each of the slave circuits 164 responds to the output signal from the amplifier 131 for purposes of establishing a ground-referenced reference voltage. As a more specific example, a specific structure for the slave circuit $\mathbf{164}_N$ is depicted in FIG. 5. Referring to this example, the slave circuit $\mathbf{164}_N$ may, for example, generate reference voltages for a differential amplifier stage, such as the stage 102 that is depicted in FIG. 4. The slave circuit $\mathbf{164}_N$ includes resistors 172 and 176 that are coupled in series. A node 174 shared in common between the resistors 172 and 176 provides the $V_{BD+\epsilon}$ voltage.

In some embodiments of the invention, the resistor 176 may have the $R_{TAIL}$ resistance; and the resistor 172 may have the RDP resistance. The slave circuit 164 includes a current source 170 that is coupled between the $V_{DD}$ supply line and the resistor 172. Due to this arrangement, the current in the current source 170 flows through the resistors 172 and 176 and due to the flow through the resistor 176 produces the $V_{BD+\epsilon}$ voltage. In some embodiments of the invention, the resistor 176 may be formed from a resistor ladder or resistor network and thus, may be similar to the resistor 144 in the master circuit 120.

Thus, in some embodiments of the invention, the current source 170 may produce the same current as the current source 146 of the master circuit 120; and the resistance that is exhibited by the resistor 176 may match the resistance exhibited by the resistor 144 to cause the $V_{BD+\epsilon}$ voltage to be the same as the $V_{BD+\epsilon}$ voltage appearing in the master circuit 120. However, it is noted that other embodiments of the invention are possible. For example, in some embodiments of the invention, the resistor 176 may be larger or smaller than the resistor 144 for purposes of scaling up or scaling down the corresponding reference voltage. Therefore, many variations are possible and are within the scope of the appended claims.

Figure 6:
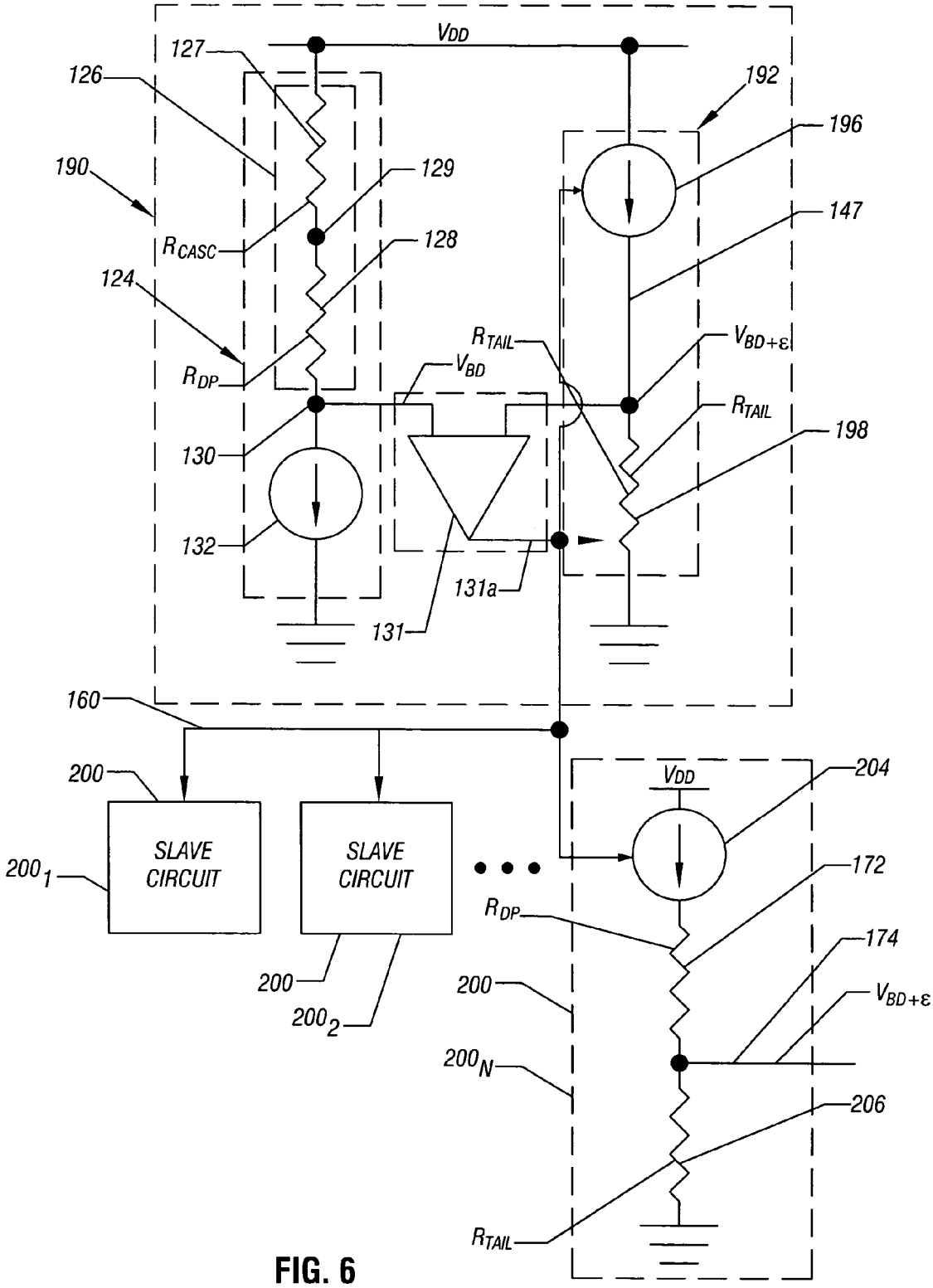

Referring to FIG. 6, in other embodiments of the invention, the master circuit may control a current in the ground-referenced voltage reference circuit for purposes of controlling the $V_{BD+\epsilon}$ voltage. More specifically, in some embodiments of the invention, in a master circuit 90, the ground-based voltage reference circuit 140 of FIG. 5 may be replaced by a ground-referenced reference voltage circuit 192. In the voltage reference circuit 192, the resistor 198 replaces the variable resistor 144 (FIG. 5). The output terminal 131*a* of the amplifier 131 does not control the resistance of the resistor 198, but instead, the signal that appears on the output terminal 131*a* controls the current flowing through a current source 196 that replaces the current source 146 (FIG. 5). Thus, due to this arrangement, the signal that appears on the output terminal 131*a* of the amplifier 131 controls the current flowing through the resistor 198 and thus, controls the level of the $V_{BD+\epsilon}$ reference voltage. In the context of this application, "current source" is used broadly to refer to either a current source or a current sink. The current source may be, for example, a supply-independent current source, such as a MOSFET threshold ($V_T$) current source whose output current is proportional to a MOSFET threshold voltage. This current source may, in turn, be calibrated to get another kind of current source, such as a $V_{ON}$/R or $V_{BG}$ current source, for example.

Slave circuits 200 (slave circuit $\mathbf{200}_1$, $\mathbf{200}_2$ . . . $\mathbf{200}_N$, depicted as examples), that replace the slave circuits 164 (FIG. 5), respond to the signal on the output terminal 131*a* in a similar manner. As a more specific example, FIG. 6 depicts the slave circuit $\mathbf{200}_N$, a circuit that forms a ground-based reference voltage circuit from a current source 204 (replacing the current source 170 (FIG. 5)) that, in response to the signal that appears on the output terminal 131*a*, produces a corresponding current in a resistor 206 (that replaces the resistor 176 (FIG. 5). Thus, due to this arrangement, the signal on the output terminal 131*a* is able to control the current that flows in the resistor 206, and thus, controls the level of the $V_{BD+\epsilon}$ voltage that appears on the node 174.

Figure 7:
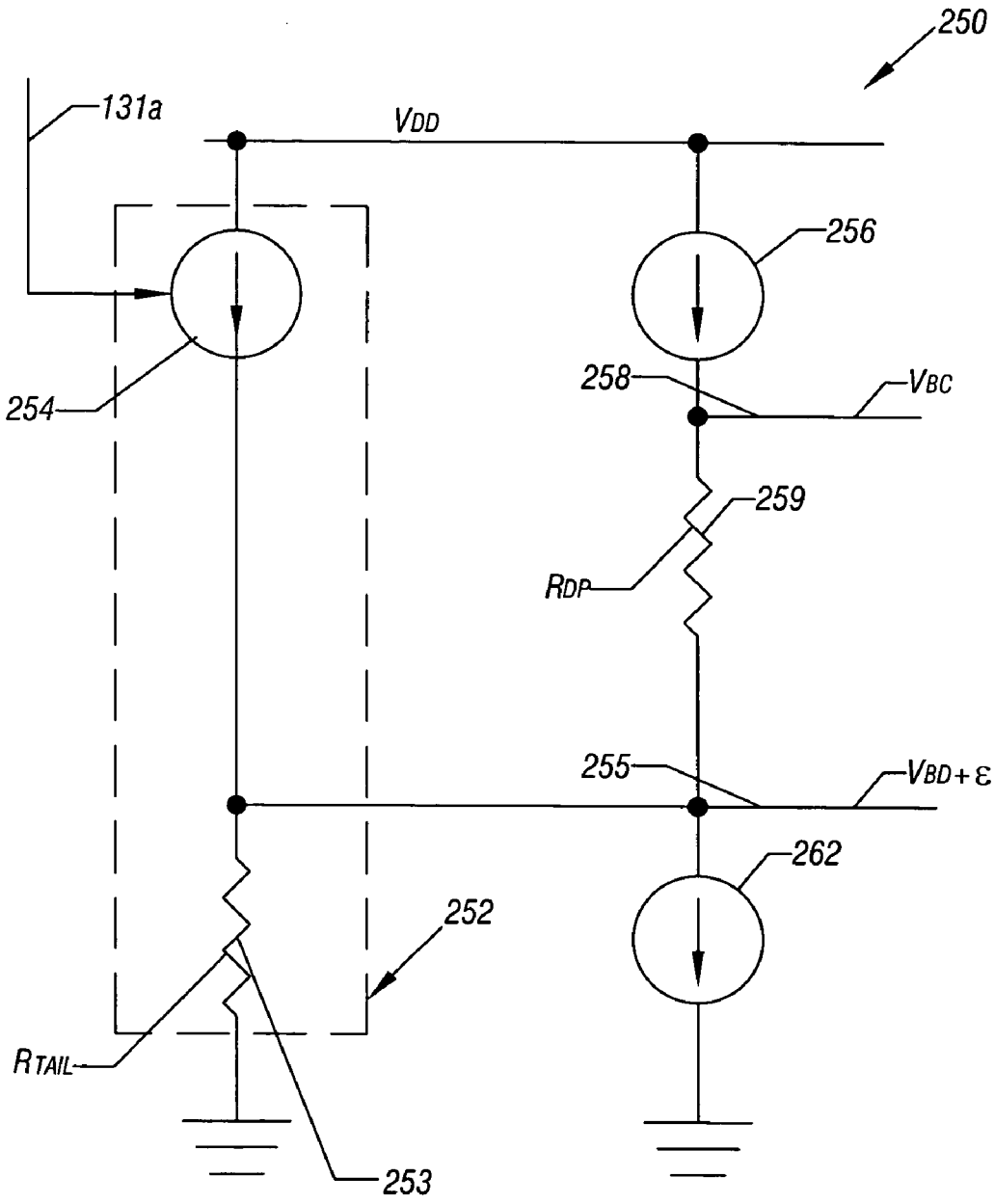

The arrangements that are described above illustrate different ways to generate the $V_{BD+\epsilon}$ voltage. For purposes of also generating the $V_{BC}$ cascode bias voltage, a slave circuit 250 that is depicted in FIG. 7 may be used. More specifically, in some embodiments of the invention, the slave circuit 250 includes a current source 254 that is controlled by the signal that appears on the output terminal 131*a*, similar to the control depicted in FIG. 6. The current source 254 is coupled between the $V_{DD}$ supply line and an output node 255 that supplies the $V_{BD+\epsilon}$ voltage. A resistor 253 (exhibiting the $R_{TAIL}$ resistance) is coupled between the output node 255 and ground. Due to this arrangement, the current through the current source 254 controls the level of the $V_{BD+\epsilon}$ voltage, similar to the control depicted in the slave circuits 200 of FIG. 6.

For purposes of generating the $V_{BC}$ voltage, additional circuitry may be employed such as current sources 256 and 262 and a resistor 259 (exhibiting the RDP resistance, for example). More specifically, the current source 256 and resistor 259 are coupled together in series between the $V_{DD}$ supply line and the output node 255; and the current source 262 is coupled between the output node 255 and ground. In some embodiments of the invention, the current source 262 supplies the same current as the current source 256. Therefore, no current from either source 256 or 262 flows into the resistor 253, and thus, the current from the current sources 256 and 262 do not affect the level of the $V_{BD+\epsilon}$ voltage.

Due to the above-described structure, the current that is established by the current sources 256 and 262 establish the $V_{BC}$ bias voltage, a voltage that is produced at a node 258 shared in common between the current source 256 and the resistor 259. More particularly, the current produced by the current sources 256 and 262 flows through the resistor 259 to establish a voltage difference between the nodes 255 and 258. This voltage difference, in turn, is relatively constant and represents a voltage step above a $V_{BD+\epsilon}$ voltage to produce the $V_{BC}$ bias voltage.

Other arrangements may be used to generate the $V_{BD+\epsilon}$ and $V_{BC}$ voltages in other embodiments of the invention. Furthermore, in some embodiments of the invention, a $V_{BC+\epsilon}$ voltage may be generated by re-referencing a $V_{BC}$ voltage from a supply line to ground. Thus, in these embodiments of the invention, the $V_{BD}$ voltage may be generated by other circuitry, such as a voltage decrease below the $V_{BC+\epsilon}$ voltage, for example. Thus, many variations are possible and are within the scope of the appended claims.

Figure 8:
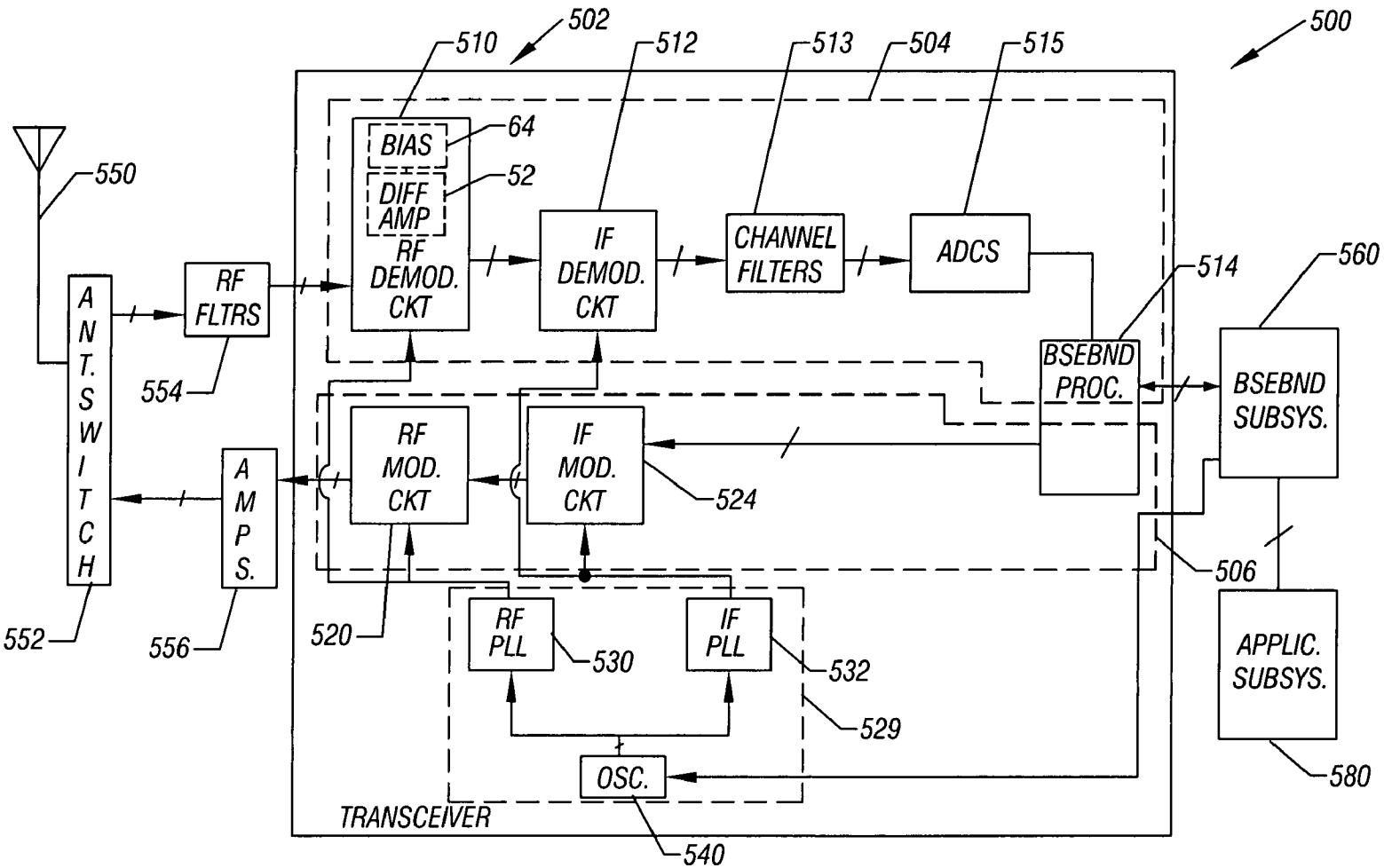
FIG. 8 is a block diagram of a wireless system according to an embodiment of the invention.

Referring to FIG. 8, in some embodiments of the invention, the bias system 64 (FIG. 2) may be used to bias circuitry (such as the differential amplifier 52 (FIG. 2)) that is part of a wireless system 500. The wireless system 500 may be a cellular telephone, a personal digital assistant (PDA) with wireless capability, as just a few examples.

More specifically, the wireless system 500 may include a radio frequency (RF) transceiver 502 that is part of a semiconductor package (or "chip"), in some embodiments of the invention. The transceiver 502 may be fabricated on one or more dies, depending on the particular embodiment of the invention.

The transceiver 502 includes receive circuitry 504 and transmit circuitry 506. The receive circuitry 504 may include, for example, an RF demodulation circuit 510 for purposes of receiving RF wireless signals that associates with one or more wireless standards (GSM, DCS and PCS standards, as examples) and demodulating the signals to produce intermediate frequency signals that are processed by an intermediate frequency (IF) demodulation circuit 512 of the receive circuitry 504.

The RF demodulation circuit 510 may include the differential amplifier 52 that receives bias voltages from the bias circuitry 64. The differential amplifier 52 may be, for example, a low noise amplifier that receives an input signal from an RF filter 554 (one out of many possible filters 554), such as a surface acoustic wave (SAW) filter, for example. The differential amplifier 52 may be one out of several differential amplifiers of the RF demodulator circuit 52, in some embodiments of the invention.

The IF demodulation circuit 512 provides demodulated signals to channel filters 513 that separate the signals based on frequency so that analog-to-digital converters (ADCs) 515 may convert these signals into digital signals that are processed by a baseband processor 514 of the transceiver 502. The baseband processor 514, in some embodiments of the invention, is a digital signal processor. As examples, the baseband processor 514 may perform such functions as channel filtering, removal of quantization noise, image reject compensation, offset calibration, etc.

In some embodiments of the invention, the transmit circuit 506 includes an IF modulation circuit 524 for purposes of modulating data to an intermediate frequency. An RF modulation circuit 520 (of the transmit circuit 506) further modulates the signals to the appropriate RF frequencies, pursuant to the particular communication standard being used for transmission.

The baseband processor 514 is an example of a component that may be shared by both the receive 504 and transmit 506 circuits of the integrated circuit 50. As another example, the transceiver 502 may include clock circuitry 329 that includes an RF phase locked loop (PLL) 530 and an IF PLL 532. The PLLs 530 and 532 produce RF and IF signals, respectively, in response to a reference frequency that is provided by an oscillator 540 of the RF transceiver 502.

Among its other features, in some embodiments of the invention, the wireless system 500 may also include various amplifiers 556 for purposes of amplifying the signals to be provided to an antenna 550, and the RF filters 554 that filter the signals that are provided by the antenna 550 to produce filtered signals that are received by the receive circuit 504. Additionally, the wireless system 500 may include, for example, an antenna switch 552 for purposes of controlling the antenna 550 depending on the particular standard being used. Furthermore, the wireless system 500 may include a baseband subsystem 560 that is coupled to the transceiver 502 for purposes of encoding and decoding data for purposes of implementing the specific wireless standard. The baseband subsystem 509 may be coupled to, for example, an application subsystem 580.

The application subsystem 580 may include various input devices, such as a keypad and an output device, such as a display, for purposes of forming an interface with a user of the wireless system 500. Furthermore, the application subsystem 580 may execute various application programs for purposes of interfacing with a user of the wireless system 500.

The wireless system 500 illustrates one out of many possible embodiments of circuitry that may employ the re-referencing technique that is disclosed herein.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus comprising:

a first voltage reference circuit to provide a first reference voltage between a terminal of the first voltage reference circuit and a first power line;

a second voltage reference circuit to provide a second reference voltage referenced between a terminal of the second voltage reference circuit and a second power line separate from the first power line; and a third circuit coupled to the second voltage reference circuit to establish a magnitude of the second reference voltage in response to a potential difference between the terminal of the first voltage reference circuit and the second power line.

2. The apparatus of claim 1, wherein the third circuit adapted to cause the second reference voltage to be approximately the same as the potential difference between the terminal of the first voltage and the second power line.

3. The apparatus of claim 1, wherein the first power line comprises a positive voltage supply line.

4. The apparatus of claim 1, wherein the second power line comprises ground.

5. The apparatus of claim 1, wherein the first voltage reference circuit comprises a resistor coupled to the first power line and a current source to provide current to the resistor to generate the first reference voltage.

6. The apparatus of claim 1, wherein the second voltage reference circuit comprises a resistor coupled to the second power line and a current source to provide a current to the resistor to generate the first reference voltage.

7. The apparatus of claim 6, wherein the third circuit adjusts a resistance of the resistor to establish the magnitude of the second reference voltage in response to the potential difference between the terminal of the first voltage reference circuit and the second power line.

8. The apparatus of claim 6, wherein the third circuit adjusts the current to establish the magnitude of the second reference voltage in response to the potential difference between the terminal of the first voltage reference circuit and the second power line.

9. The apparatus of claim 1, further comprising:

a third voltage reference circuit to establish a third reference voltage between an output terminal of the third voltage reference circuit and the terminal of the second voltage reference circuit.

10. The apparatus of claim 1, wherein the first voltage reference circuit maintains the first reference voltage relatively constant in response to changes in a voltage of the first power supply line.

11. An apparatus comprising:

a first voltage reference circuit to provide a first reference voltage between a terminal of the first voltage reference circuit and a supply voltage line;

a second voltage reference circuit to provide a second reference voltage referenced between a terminal of the second voltage reference circuit and ground separate from the supply voltage line; and a third circuit coupled to the second voltage reference circuit to establish a magnitude of the second reference voltage in response to a potential difference between the terminal of the first voltage reference circuit and ground.

12. The apparatus of claim 11, wherein the third circuit adapted to cause the second reference voltage to be approximately the same as the potential difference between the terminal of the first voltage and ground.

13. The apparatus of claim 11, wherein the first voltage reference circuit comprises a resistor coupled to the supply voltage line and a current source to provide current to the resistor to generate the first reference voltage.

14. The apparatus of claim 11, wherein the second voltage reference circuit comprises a resistor coupled to ground and a current source to provide a current to the resistor to generate the first reference voltage.

15. The apparatus of claim 14, wherein the third circuit adjusts a resistance of the resistor to establish the magnitude of the second reference voltage in response to the potential difference between the terminal of the first voltage reference and ground.

16. The apparatus of claim 14, wherein the circuit adjusts the current to establish the magnitude of the second reference voltage in response to the potential difference between the terminal of the first voltage reference circuit and ground.

17. The apparatus of claim 11, further comprising:

a third voltage reference circuit to establish a third reference voltage between an output terminal of the third voltage reference circuit and the terminal of the second voltage reference.

18. The apparatus of claim 11, wherein the first voltage reference circuit maintains the first reference voltage relatively constant in response to changes in a voltage of the supply voltage line.

19. The apparatus of claim 18, further comprising:

a differential amplifier comprising at least one cascode transistor to receive the third reference voltage.

20. The apparatus of claim 11, further comprising:

a differential amplifier comprising a differential pair of transistors to receive the second reference voltage to bias the differential pair.

21. The apparatus of claim 11, wherein the circuit comprises an amplifier to establish the magnitude of the second reference voltage to minimize a difference between the terminal of the first voltage reference circuit and ground.

22. A method comprising:

receiving a first reference voltage existing between a first terminal and a first power line;

providing a second reference voltage referenced between a second terminal and a second power line separate from the first power line; and regulating a magnitude of the second reference voltage in response to a potential difference between the terminal of the first voltage reference circuit and the second power line.

23. The method of claim 22, wherein the regulating comprises maintaining the magnitude of the second reference voltage approximately the same as the magnitude of the potential difference between the terminal of the first voltage reference circuit and the second power line.

24. The method of claim 22, wherein the first power line comprises a positive voltage supply line and the second power line comprises ground.

25. The method of claim 22, wherein the regulating comprises controlling a current source.

26. The method of claim 22, wherein the regulating comprises controlling a resistance between the terminal and a second power line.

27. The method of claim 22, further comprising:

providing a third reference voltage between the second output terminal of the first power line.

28. A system comprising:

a wireless interface comprising an amplifier to receive the second reference voltage to bias the amplifier;

a first voltage reference circuit to provide a first reference voltage between a terminal of the first voltage reference circuit and a supply voltage line;

a second voltage reference circuit to provide a second reference voltage referenced between a terminal of the second voltage reference circuit and ground separate from the supply voltage line; and a third circuit coupled to the second voltage reference circuit to establish a magnitude of the second reference voltage in response to a potential difference between the terminal of the first voltage reference circuit and ground.

29. The system of claim 28, wherein the circuit adapted to cause the second reference voltage to be approximately the same as the potential difference between the terminal of the first voltage and ground.

30. The system of claim 28, wherein the first voltage reference circuit comprises a resistor coupled to the supply voltage line and a current source to provide current to the resistor to generate the first reference voltage.

31. The system of claim 28, wherein the second voltage reference circuit comprises a resistor coupled to ground and a current source to provide a current to the resistor to generate the first reference voltage.

32. The system of claim 31, wherein the third circuit adjusts a resistance of the resistor to establish the magnitude of the second reference voltage in response to the potential difference between the terminal of the first voltage reference and ground.

33. The system of claim 31, wherein the circuit adjusts the current to establish the magnitude of the second reference voltage in response to the potential difference between the terminal of the first voltage reference and ground.

34. The system of claim 28, further comprising:

a third voltage reference circuit to establish a third reference voltage between an output terminal of the third voltage reference circuit and the terminal of the second voltage reference circuit.

35. The system of claim 28, wherein the first voltage reference circuit maintains the first reference voltage relatively constant in response to changes in a voltage of the supply voltage line.

36. A method comprising:

providing a ground-based reference voltage circuit to provide a reference voltage to bias another circuit; and controlling the reference voltage circuit to track changes in a supply voltage.

37. The method of claim 36, wherein the controlling comprises:

controlling a resistance of a resistor.

38. The method of claim 36, wherein the controlling comprises:

controlling a current.

39. The method of claim 36, wherein said another circuit comprises a differential amplifier.

40. A method comprising:

generating a reference voltage that is referenced to a first power line; and re-referencing the reference voltage to a second power line separate from the first power line.

41. The method of claim 40, wherein the first power line comprises a supply voltage line and the second power line comprises ground.

42. The method of claim 40, wherein the re-referencing comprises re-referencing the reference voltage to ground.

43. The method of claim 40, wherein the controlling comprises at least one of controlling a current and a resistance.

44. The method of claim 40, further comprising:

providing the reference circuit to a differential amplifier to bias the differential amplifier.

* * * * *